US010788250B2

(12) United States Patent
Junge et al.

(10) Patent No.: US 10,788,250 B2
(45) **Date of Patent: *Sep. 29, 2020**

(54) ICE MAKING ASSEMBLIES AND METHODS FOR MAKING CLEAR ICE

(71) Applicant: Haier US Appliance Solutions, Inc., Wilmington, DE (US)

(72) Inventors: Brent Alden Junge, Evansville, IN (US); Justin Tyler Brown, Louisville, KY (US); Daniel Carballo, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 125 days.

This patent is subject to a terminal disclaimer.

(21) Appl. No.: 16/044,556

(22) Filed: Jul. 25, 2018

(65) Prior Publication Data

US 2020/0033042 A1 Jan. 30, 2020

(51) Int. Cl.
*F25C 1/18* (2006.01)
*F25C 1/22* (2018.01)

(52) U.S. Cl.
CPC . *F25C 1/18* (2013.01); *F25C 1/22* (2013.01)

(58) Field of Classification Search
CPC ..... F25C 1/18; F25C 1/22; F25C 1/04; F25C 5/08; F25C 2600/02; F25C 2700/12; F25C 1/145
USPC ..... 62/75
See application file for complete search history.

(56) References Cited

U.S. PATENT DOCUMENTS 6,357,720 B1 * 3/2002 Shapiro ..... F25C 1/10 249/119
9,574,811 B2 2/2017 Papalia
9,784,492 B2 10/2017 Little
2010/0186429 A1 * 7/2010 Watson ..... F25D 17/065 62/66
2015/0027142 A1 1/2015 Little

FOREIGN PATENT DOCUMENTS

WO WO2017216294 A1 12/2017

* cited by examiner

*Primary Examiner* — Steve S Tanenbaum
(74) *Attorney, Agent, or Firm* — Dority & Manning, P.A.

(57) ABSTRACT

An ice making assembly and method for making clear ice utilizing an ice making appliance are provided herein. The ice making appliance may include a cabinet, an ice mold, a heating element, and a controller. The ice mold may be positioned within the freezer chamber and define a mold cavity. The heating element may be mounted within the ice mold in conductive thermal communication with the mold cavity. The controller may be configured to initiate an ice making operation. The ice making operation may include maintaining the freezer chamber below a first sub-freezing during an ice formation cycle subsequent to a volume of water being received within the mold cavity, and heating the ice mold during the ice formation cycle at the heating element as a portion of the volume of water freezes to a frozen volume.

18 Claims, 5 Drawing Sheets

ICE MAKING ASSEMBLIES AND METHODS FOR MAKING CLEAR ICE

FIELD OF THE INVENTION

The present subject matter relates generally to ice making appliances and methods, and more particularly to appliances and methods for making substantially clear ice.

BACKGROUND OF THE INVENTION

In domestic and commercial applications, ice is often formed as solid cubes, such as crescent cubes or generally rectangular blocks. The shape of such cubes is often dictated by the environment during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes.

In typical ice making appliances, water in the cavities begins to freeze and solidify first from its sides and outer surfaces (including a top water surface that may be directly exposed to freezing air), and then in and through the remaining volume of water occupying the cavity. In other words, the exterior surfaces of an ice cube freeze first. However, impurities and gases contained within the water to be frozen may be trapped in a solidified ice cube during the freezing process. For example, impurities and gases may be trapped near the center or the bottom surface of the ice cube, due to their inability to escape and as a result of the freezing liquid to solid phase change of the ice cube surfaces. Separate from or in addition to the trapped impurities and gases, a dull or cloudy finish may form on the exterior surfaces of an ice cube (e.g., during rapid freezing of the ice cube). Generally, a cloudy or opaque ice cube is the resulting product of typical ice making appliances.

Although typical ice cubes may be suitable for a number uses, such as temporary cold storage and rapid cooling of liquids in a wide range of sizes, they may present several disadvantages. As an example, impurities and gases trapped within an ice cube may impart undesirable flavors into a beverage being cooled (i.e., a beverage in which the ice cube is placed) as the ice cube melts. Such impurities and gases may also cause an ice cube to melt unevenly or faster (e.g., by increasing the exposed surface area of the ice cube). Evenly-distributed or slow melting of ice may be especially desirable in certain liquors or cocktails. Additionally or alternatively, it has been found that substantially clear ice cubes (e.g., free of any visible impurities or dull finish) may provide a unique or upscale impression for the user.

Accordingly, further improvements in the field of ice making would be desirable. In particular, it may be desirable to provide an appliance or methods for rapidly and reliably producing substantially clear ice.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of making ice is provided. The method may include providing a volume of water within a mold cavity defined within an ice mold. The ice mold may be positioned within a freezer chamber. The mold cavity may include a cavity opening at a top portion thereof. The cavity opening may extend in a vertical direction in fluid communication between the freezer chamber and the mold cavity. The method may also include maintaining the freezer chamber below a first sub-freezing temperature during an ice formation cycle as a portion of the volume of water freezes to a frozen volume. The method may further include heating the ice mold during the ice formation cycle at a heating element mounted within the ice mold.

In another exemplary aspect of the present disclosure, an ice making appliance is provided. The ice making appliance may include a cabinet, an ice mold, a heating element, and a controller. The cabinet may define a freezer chamber. The ice mold may be positioned within the freezer chamber. The ice mold may define a mold cavity extending vertically in fluid communication with the freezer chamber through a vertical opening. The heating element may be mounted within the ice mold in conductive thermal communication with the mold cavity. The controller may be in operable communication with the heating element. The controller may be configured to initiate an ice making operation. The ice making operation may include maintaining the freezer chamber below a first sub-freezing during an ice formation cycle subsequent to a volume of water being received within the mold cavity, and heating the ice mold during the ice formation cycle at the heating element as a portion of the volume of water freezes to a frozen volume.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
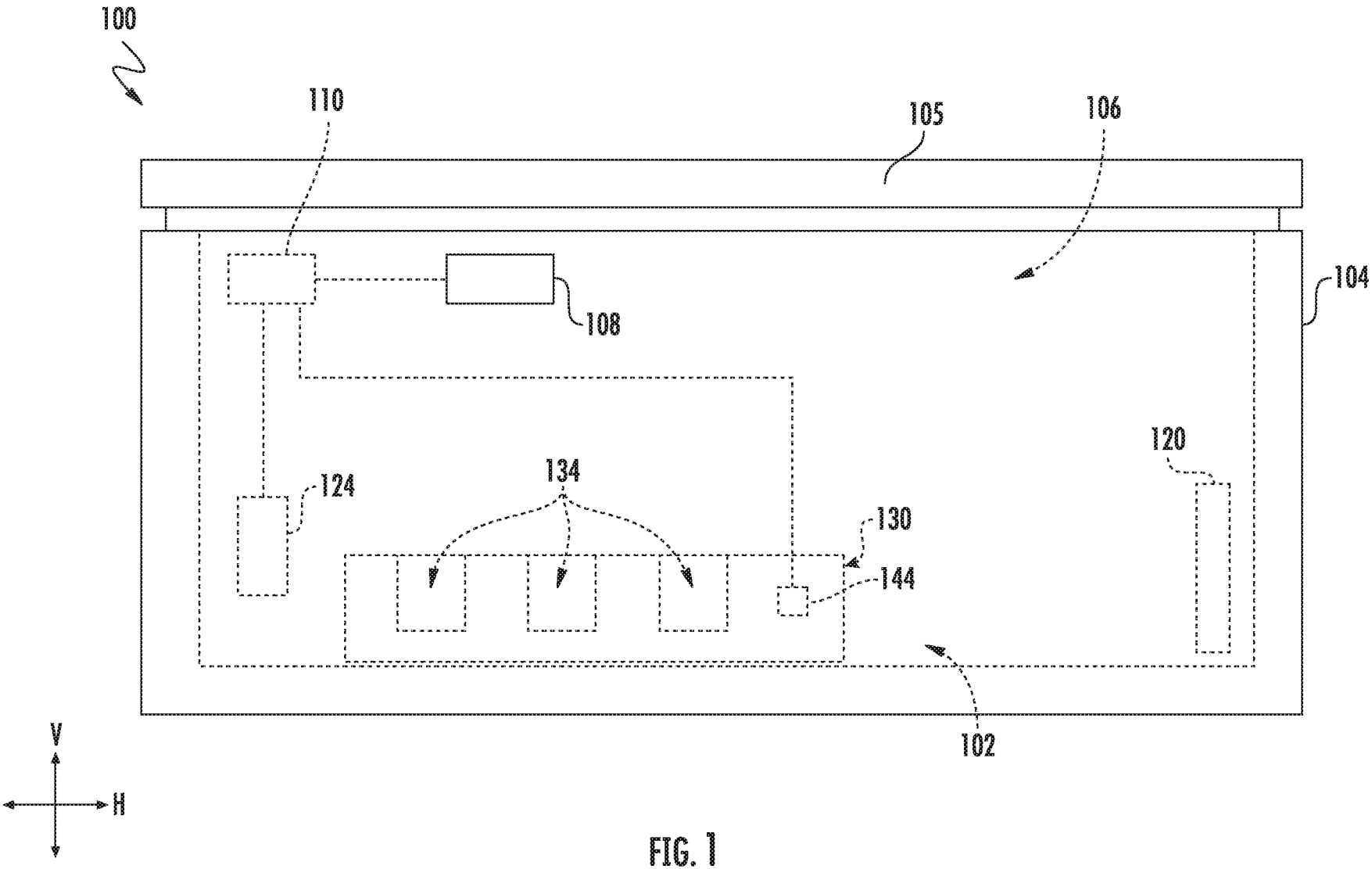
FIG. 1 provides a side plan view of an ice making appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The term "or" is generally intended to be inclusive (i.e., "A or B" is intended to mean "A or B or both").

Figure 2:
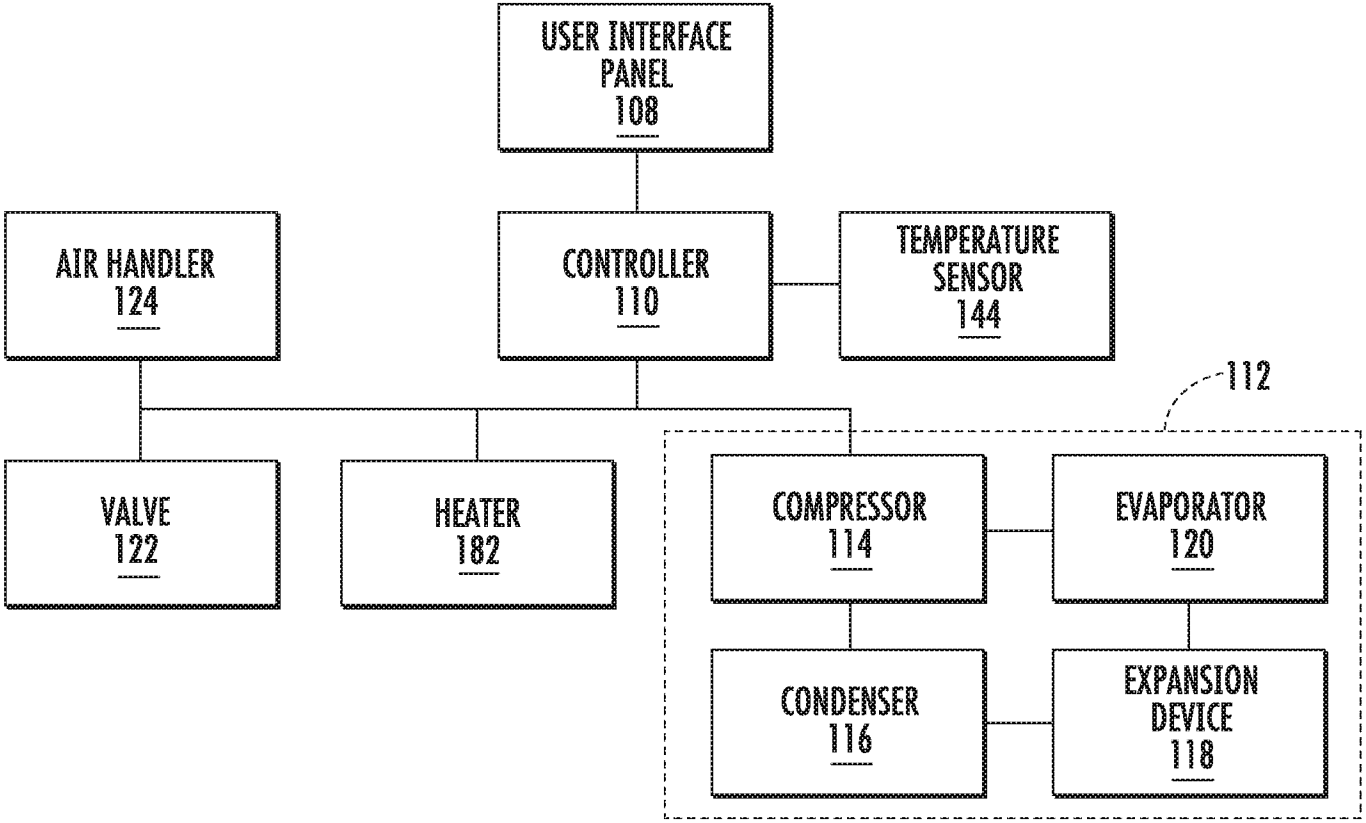
FIG. 2 provides a schematic view of an ice making assembly according to exemplary embodiments of the present disclosure.
Figure 3:
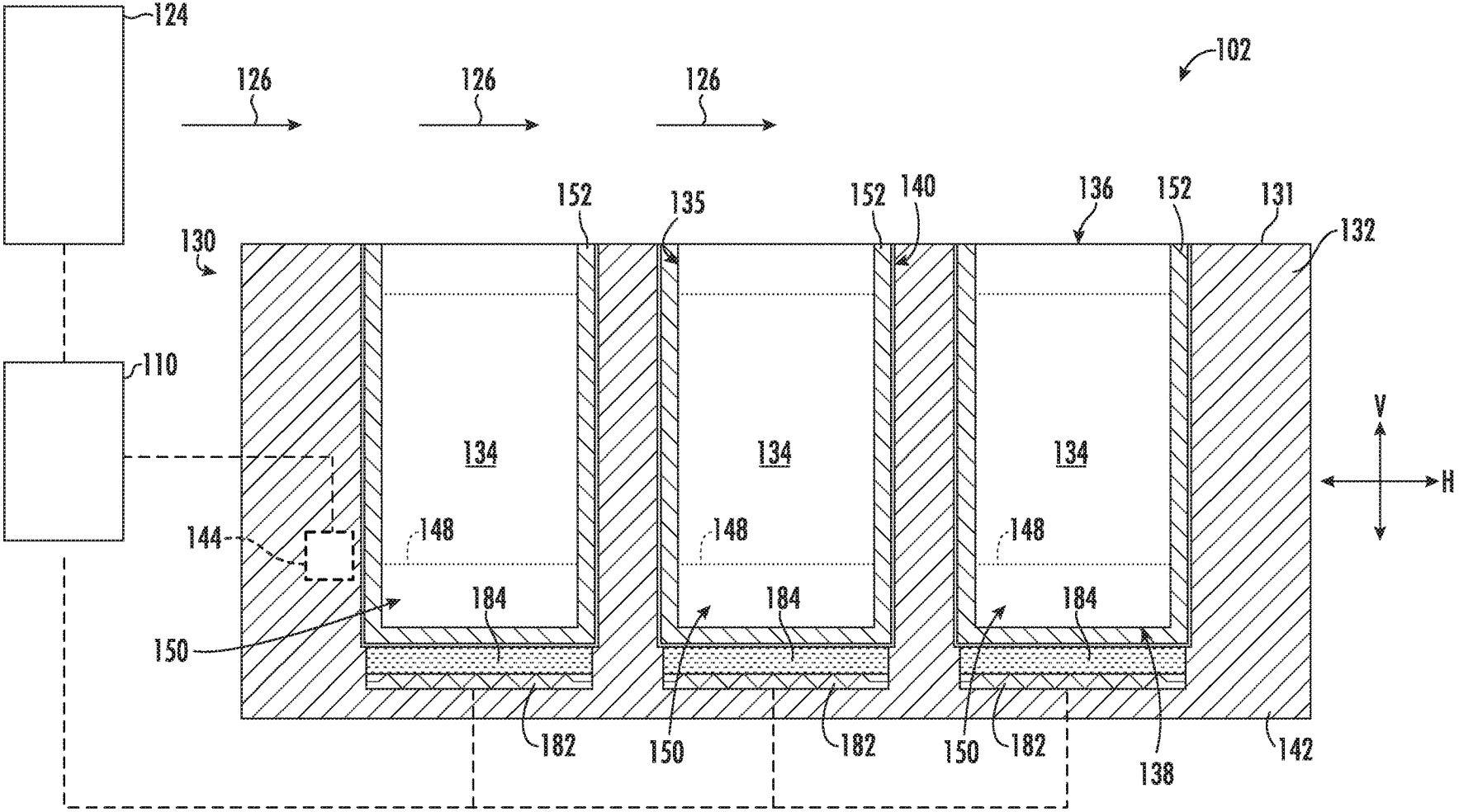
FIG. 3 provides a cross-sectional schematic view of a portion of an ice making assembly according to exemplary embodiments of the present disclosure.
Figure 4:
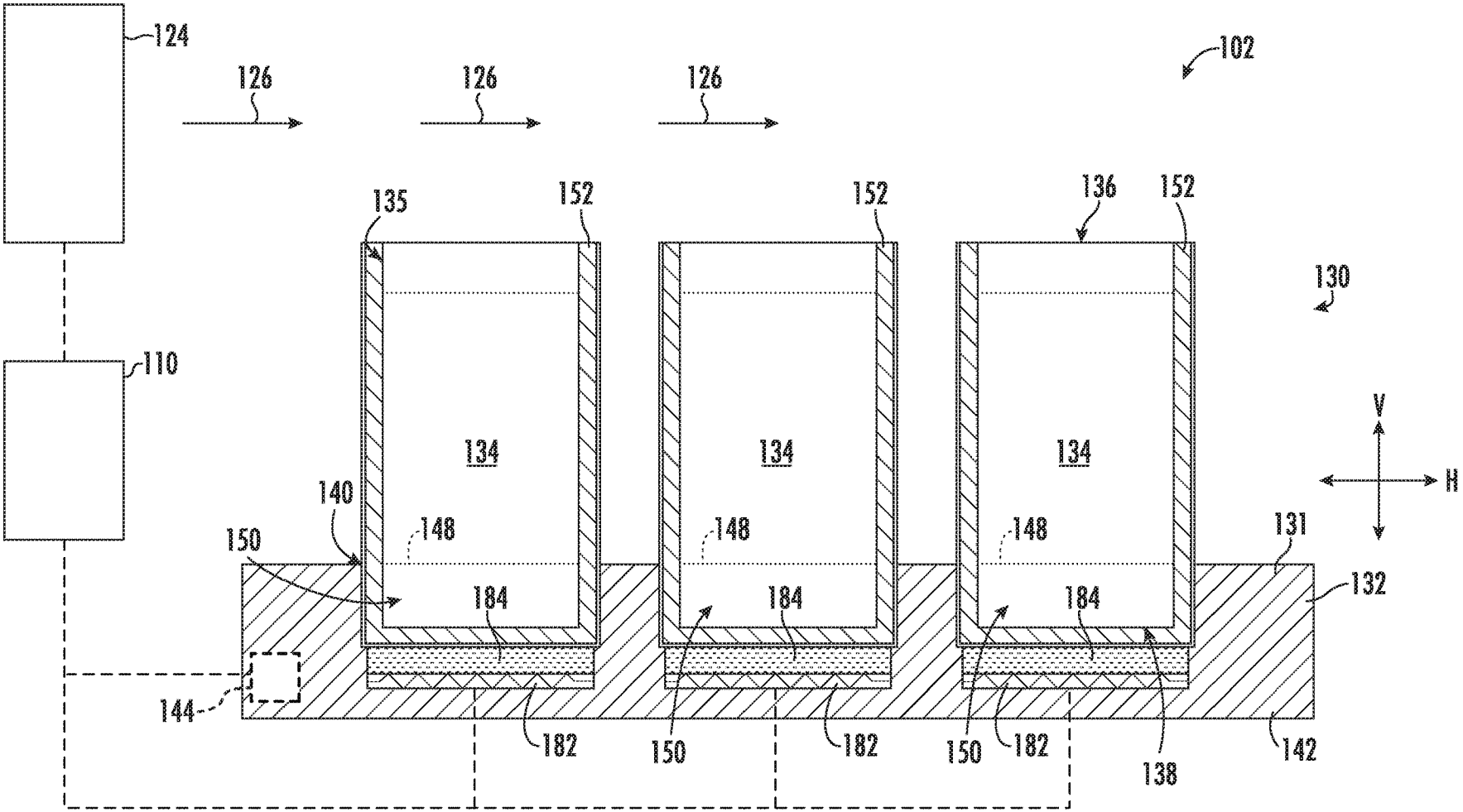
FIG. 4 provides a cross-sectional schematic view of a portion of an ice making assembly according to exemplary embodiments of the present disclosure.

Turning now to the figures, FIG. 1 provides a side plan view of an ice making appliance 100, including an ice making assembly 102. FIG. 2 provides a schematic view of ice making assembly 102. FIG. 3 provides a cross-sectional schematic view of a portion of ice making assembly 102. FIG. 4 provides a cross-sectional schematic view of a portion of ice making assembly 102 according to other exemplary embodiments of the present disclosure.

Generally, ice making appliance 100 includes a cabinet 104 (e.g., insulated housing) and defines a mutually orthogonal vertical direction V, lateral direction, and transverse direction. The lateral direction and transverse direction may be generally understood to be horizontal directions H. As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance (e.g., a top mount refrigerator appliance, a bottom mount refrigerator appliance, a side-by-side style refrigerator appliance, etc.) that includes a freezer chamber. Consequently, the description set forth herein is for illustrative purposes only and is not intended to be limiting in any aspect to any particular chamber configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion of the cabinet 104). As would be understood, door 105 may selectively cover an opening defined by cabinet 104. For instance, door 105 may rotate on cabinet 104 between an open position (not pictured) permitting access to freezer chamber 106 and a closed position (FIG. 1) restricting access to freezer chamber 106.

A user interface panel 108 is provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to or in wireless communication with user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive media) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in operable communication with controller 110 via one or more signal lines or shared communication busses.

As illustrated, controller 110 may be in communication with the various components of ice making assembly 102 and may control operation of the various components. For example, various valves, switches, etc. may be actuatable based on commands from the controller 110. As discussed, user interface panel 108 may additionally be in communication with the controller 110. Thus, the various operations may occur based on user input or automatically through controller 110 instruction.

In some embodiments, ice making appliance 100 includes a sealed cooling system 112 for executing a vapor compression cycle for cooling ice making assembly 102 or air within ice making appliance 100 (e.g., within freezer chamber 106). Sealed cooling system 112 includes a compressor 114, a condenser 116, an expansion device 118, and an evaporator 120 connected in fluid series and charged with a refrigerant. As will be understood by those skilled in the art, sealed cooling system 112 may include additional components (e.g., at least one additional evaporator, compressor, expansion device, or condenser). Moreover, at least one component (e.g., evaporator 120) is provided in thermal communication with freezer chamber 106 to cool the air or environment within freezer chamber 106. Optionally, evaporator 120 is mounted within freezer chamber 106, as generally illustrated in FIG. 1.

Within sealed cooling system 112, gaseous refrigerant flows into compressor 114, which operates to increase the pressure of the refrigerant. This compression of the refrigerant raises the refrigerant temperature, which is lowered by passing the gaseous refrigerant through condenser 116. Within condenser 116, heat exchange (e.g., with ambient air takes place) to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120.

Upon exiting expansion device 118 and entering evaporator 120, the liquid refrigerant drops in pressure and vaporizes. Due to the pressure drop and phase change of the refrigerant, evaporator 120 is cool relative to freezer chamber 106. As such, cooled air is produced and refrigerates freezer chamber 106. Thus, evaporator 120 is a heat exchanger which transfers heat (e.g., from air passing over evaporator 120 to refrigerant flowing through evaporator 120).

Optionally, ice making appliance 100 further includes a valve 122 for regulating a flow of liquid water to ice making assembly 102 from a suitable water source (e.g., on-board water tank or municipal water source). Valve 122 is selectively adjustable between an open configuration and a closed configuration. In the open configuration, valve 122 permits a flow of liquid water to ice making assembly 102. Conversely, in the closed configuration, valve 122 hinders the flow of liquid water to an ice mold 130.

In certain embodiments, ice making appliance 100 also includes an air handler 124 mounted within (or otherwise in fluid communication with) freezer chamber 106. Air handler 124 may be operable to urge a flow of chilled air (i.e., active airflow—as indicated at arrows 126) within freezer chamber 106. Moreover, air handler 124 can be any suitable device for moving air. For example, air handler 124 can be an axial fan or a centrifugal fan. In some embodiments, air handler 124 is in operable (e.g., electrical or wireless) communication with controller 110.

As shown, an ice mold 130 may be provided within freezer chamber 106. For example, ice mold 130 (e.g., the entirety of ice mold 130 or, alternatively, a sub portion thereof) may be removably positioned within freezer chamber 106 such that a user may selectively place ice mold 130 within freezer chamber 106 (e.g., during ice making operations) and remove ice mold 130 from freezer chamber 106 (e.g., to remove frozen ice cubes or billets from ice mold 130) as desired. As shown, ice mold 130 includes an insulated mold body 131 and generally defines one or more mold cavities 134 in which water may be received and ice cubes or billets (e.g., solid masses or blocks of ice that may be further melted to a final shape) may be formed. Generally, each mold cavity 134 may extend the vertical direction V between a top portion 136 and a bottom portion 138.

In some embodiments, mold body 131 includes one or more insulated sidewalls 132 positioned about the mold cavities 134 and defining a vertical opening 140. A base wall 142 (e.g., insulated base wall) may extend below the insulated sidewalls 132 and mold cavities 134. It is understood that ice mold 130 may be formed from any suitable material. In some embodiments, one or more thermally insulating materials are utilized to form ice mold 130. The sidewalls 132 may be insulated sidewalls 132 and the ice mold 130 may be an insulated ice mold 130. As an example, one or more of the sidewalls 132 may define a sealed insulation volume to surround at least a portion of mold cavity 134. The sealed insulation volume may generally prevent the passage of air or oxygen to or from a volume within each sidewall 132 (e.g., as a substantially evacuated a vacuum or a volume filled with a set mass of gas, such as nitrogen, oxygen, argon, or a suitable inert gas). As another example, one or more of the sidewalls 132 may be formed or filled with a solid insulating material (e.g., a rigid polyurethane insulating foam) to hinder to heat transfer between each mold cavity 134 and its surrounding environment (e.g., freezer chamber 106).

Optionally, the mold cavities 134 may be defined as open voids in fluid communication with freezer chamber 106. For instance, air or water may freely pass through the top portion 136 of mold cavity 134. After entering mold cavity 134, however, air or water will be prevented from passing through the bottom portion 138. In some such embodiments, vertical opening 140 of the mold body 131 has a horizontal diameter that is equal to or greater than the horizontal diameter of the mold cavity 134.

In certain embodiments, a removable sleeve 152 is provided for selective insertion/removal within the mold body 131. In turn, one or more of the mold cavities 134 may be defined by a corresponding removable sleeve 152 (e.g., from top portion 136 to a bottom portion 138). As shown, removable sleeve 152 may be shaped to generally complement the surfaces of sidewalls 132 and base wall 142. Removable sleeve 152 may thus fit through and within vertical opening 140. A cavity opening 135 (e.g., parallel to or concentric with vertical opening 140) is defined through removable sleeve 152 at the top portion 136 of the corresponding mold cavity 134. During use, a volume of water may be provided to removable sleeve 152 (e.g., through cavity opening 135) and ice may be formed therein (i.e., as at least a portion of the volume of water within mold cavity 134 transitions to a frozen volume). Once a volume of water is frozen (e.g., as an ice cube or billet), removable sleeve 152 and the frozen volume may be removed together from mold body 131. As is understood, removable sleeve 152 may be formed from any suitable material, such as a synthetic polymer capable of maintaining a predetermined elastic shape as removable sleeve 152 is subjected to disparate temperatures (e.g., as removable sleeve 152 is placed into and removed from freezer chamber 106).

Turning specifically now to FIG. 3, in some embodiments, the insulated sidewalls 132 may extend along substantially all of mold cavity 134. For instance, the sidewalls 132 may extend along the vertical direction V from the top portion 136 to the bottom portion 138. The sidewalls 132 may enclose a corresponding removable sleeve 152 (e.g., when the removable sleeve 152 is received within the mold body 131).

Turning specifically now to FIG. 4, in other embodiments, the insulated sidewalls 132 may extend along a limited portion of mold cavity 134. For instance, the sidewalls 132 may extend along the vertical direction V from the bottom portion 138 to the predetermined ballast height 148 within mold cavity 134. In other words, the vertical extension or height of the sidewalls 132 may terminate at the ballast height 148. When the removable sleeve 152 is received within the mold body 131, at least a portion of the removable sleeve 152 extends above the vertical opening 140 and insulated sidewalls 132. Thus, the sidewalls 132 may be shorter than the removable sleeve 152.

Advantageously, the relative position of sidewalls 132 may contain heat at and below the ballast height 148. In turn, formation of a liquid ballast within mold cavity and below a frozen volume may be promoted.

Returning generally to FIGS. 1 through 4, a heater 182 is generally positioned in conductive thermal communication with a mold cavity 134. For instance, within mold body 131, a heater 182 may be positioned below each mold cavity 134. In some such embodiments, each mold cavity 134 may be provided with a corresponding heater 182 therebelow. Generally, heater 182 includes, or is provided as, a suitable electrical heating element (e.g., resistive heating element, radiant heating element, etc.). In some embodiments, each heater 182 is in operable (e.g., electrical or wireless) communication with controller 110.

During use (e.g., an ice formation cycle), heater 182 may be selectively activated to conduct heat to the mold cavity 134, thereby hindering at least a portion of the volume of water within mold cavity 134 from freezing. In some instances, a liquid ballast may be formed from a portion of the volume of water within the mold cavity 134 (e.g., at the bottom portion 138) while a frozen volume is formed from another portion of the volume of water above the liquid ballast. Advantageously, impurities may settle within the liquid ballast and be prevented from becoming frozen or encased within the frozen volume.

In optional embodiments, a suitable phase change material (PCM) is positioned in thermal communication with mold cavity 134. For instance, a PCM segment 184 may be positioned within the mold body 131 below the vertical opening 140. Within the PCM segment 184, one or more solid or nonpermeable surfaces may enclose the PCM material (e.g., vegetable oil based PCM). In exemplary embodiments, the PCM segment 184 is formed below the mold cavity 134. In particular, PCM segment 184 may extend along the bottom portion 138 of the corresponding mold cavity 134. When the removable sleeve 152 is placed within mold body 131, a bottom end of the removable sleeve 152 may be supported on the PCM segment 184. Optionally, PCM segment 184 may be positioned between the heater 182 and the mold cavity 134 (e.g., along the vertical direction V). Advantageously, PCM segment 184 may promote even or consistent heat distribution and encourage formation of the liquid ballast below a frozen volume of water within mold cavity 134.

When assembled, an air handler 124 may be positioned above (or otherwise located at a position to) direct an active airflow 126 across the top portion 136 of mold cavity 134 or removable sleeve 152 (e.g., perpendicular to cavity opening 135). Thus, an active airflow 126 may be selectively motivated across ice mold 130, thereby accelerating heat transfer from mold cavity 134. For instance, air handler 124 may be configured to motivate the active airflow 126 at one or more predetermined flow rates (e.g., volumetric flow rates) within freezer chamber 106.

In some embodiments, one or more sensors are mounted on or within ice mold 130. As an example, a temperature sensor 144 may be mounted to ice mold 130. Temperature sensor 144 may be in operable (e.g., electrical or wireless) communication with controller 110 and configured to detect the temperature within ice mold 130 or mold cavity 134. Temperature sensor 144 may be formed as any suitable temperature detecting device, such as a thermocouple, thermistor, etc. Optionally, temperature sensor 144 may be mounted at a predetermined height along one of the sidewalls 132. In some such embodiments, the predetermined height is the ballast height 148 below the top portion 136 of mold cavity 134, as illustrated in FIG. 3. Alternatively, the temperature sensor 144 may be mounted at another suitable location within mold body 131, such as below the bottom portion 138 of mold cavity 134, as illustrated in FIG. 4.

As noted above, during use (e.g., during ice making operations), a liquid ballast 150 may form below a frozen volume (e.g., ice cube or billet) within mold cavity 134. Advantageously, impurities within the volume of water from which the frozen volume is formed may accumulate within the liquid ballast 150 as a portion of the volume of water freezes. Detection of a predetermined temperature at the temperature sensor 144 (e.g., at the ballast height 148) may indicate the frozen volume has reached the ballast height 148. Optionally, controller 110 may be configured to adjust one or more operations of the ice making assembly 102 in response to determining that the ice mold 130 has frozen to the ballast height 148.

Figure 5:
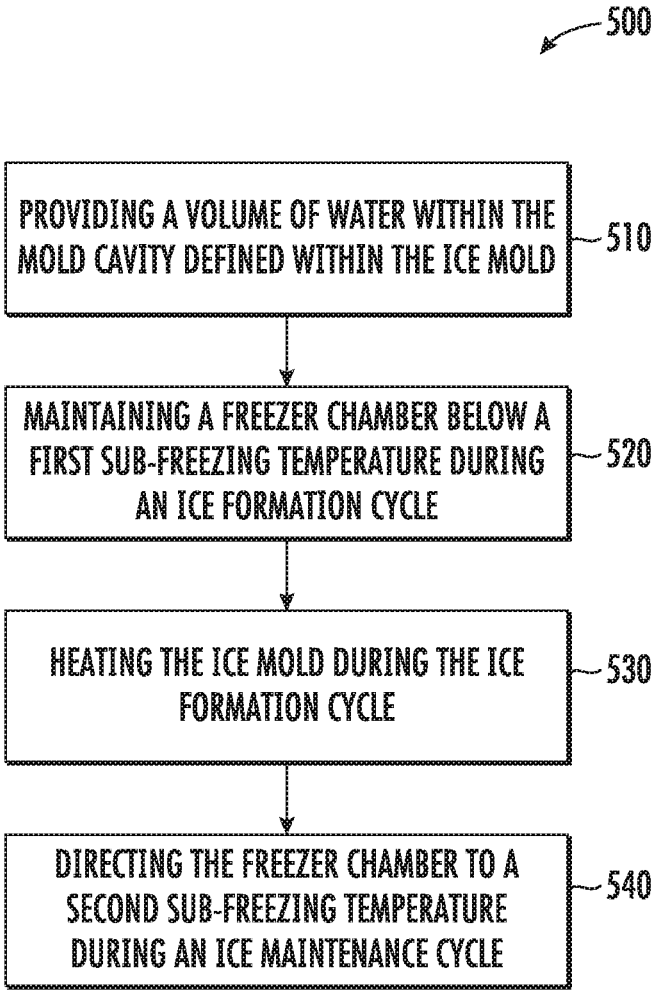
FIG. 5 provides a flow chart illustrating a method of operating an ice making appliance in accordance with an exemplary embodiment of the present disclosure.

Referring now to FIG. 5, various methods (e.g., method 500) may be provided for use with the ice making appliance 100 or ice making assembly 102 (FIG. 1) in accordance with the present disclosure. In some embodiments, such as the exemplary embodiments illustrated by method 500, all or some of the various steps of the methods may be performed by controller 110 (FIG. 1). For example, controller 110 may, as discussed, be operably coupled to or in operable communication with one or more of sealed cooling system 112, valve 122, interface panel 108, air handler, 124, or temperature sensor 144 (FIG. 2). During use, controller 110 may send signals to receive signals from some or all of these components. Controller 110 may further be operably coupled to or in operable communication with other suitable components of the appliance 100 or assembly 102 to facilitate operation of the appliance 100 or assembly 102 generally. Present methods may advantageously facilitate the formation or creation of substantially clear ice cubes or billets. Moreover, such methods may advantageously permit substantially clear ice to be produced in less than 14 hours (e.g., following initiation thereof).

FIG. 5 depicts steps performed in a particular order for purpose of illustration and discussion. Those of ordinary skill in the art, using the disclosures provided herein, will understand that (except as otherwise indicated) the steps of method 500 disclosed herein can be modified, adapted, rearranged, omitted, or expanded in various ways deviating from the scope of the present disclosure.

As shown in FIG. 5, at 510, the method 500 includes providing a volume of water within the mold cavity defined within the ice mold. In some embodiments, the ice mold is an insulated ice mold. Thus, the ice mold may include one or more insulated sidewalls, as described above. The cavity opening may extend vertically and generally be exposed or uncovered (e.g., relative to surrounding environment). When positioned within the freezer chamber, the cavity opening may thus be in fluid communication between freezer chamber and the mold cavity.

It is understood that the volume of water provided to the mold cavity may be provided manually or, alternatively, automatically. For instance, when provided manually, the volume of water in mold cavity may be poured directly by a user supplying the water to mold cavity. By contrast, when provided automatically, the controller may control or actuate the valve of the ice making assembly to open, thereby permitting volume of water to flow to the mold cavity. Additionally or alternatively, a pump of a water distribution assembly may be actuated to provide water from a suitable water source (e.g., on-board water tank or municipal water source). Although described as automatic, is understood that controller may operate (e.g., transmit one or more signals to the valve) in response to one or more user input signals received from the user interface. Moreover, it is understood that the volume of water may be provided to the mold cavity while the ice mold is positioned within or, alternatively, outside of freezer chamber. However, the purposes of the method 500, once the volume of water is provided within the mold cavity, the ice mold is understood to be positioned within the freezer chamber (e.g., for the duration of steps 520 through 540).

At 520, the method 500 includes maintaining the freezer chamber below a first sub-freezing temperature during an ice formation cycle. The ice formation cycle may be performed while the ice mold (and thereby the volume of water within the mold cavity) is positioned within the freezer chamber. Thus, the ice mold is maintained or held below the first sub-freezing temperature for the duration of the ice formation cycle as a portion of the volume of water freezes to a frozen volume (e.g., ice cube or billet). During the ice formation cycle, the freezer chamber may be maintained at a relatively stable temperature (e.g., between −10° Fahrenheit and 10° Fahrenheit). In some embodiments, the first sub-freezing temperature may be 10° Fahrenheit. In other embodiments, the first sub-freezing temperature may be 5° Fahrenheit. In further embodiments, the first sub-freezing temperature may be 0° Fahrenheit.

As described above, the sealed cooling system may be activated or otherwise directed to cool the freezer chamber. For instance, during the ice formation cycle, heat may be drawn from the freezer chamber or ice mold at the evaporator. As would be understood, the sealed cooling system may be selectively activated by the controller (e.g., based on one or more temperature signals received from a temperature sensor mounted to the ice making appliance or within the freezer chamber).

At 530, the method 500 includes heating the ice mold during the ice formation cycle (e.g., during at least a portion of the ice formation cycle). In particular, the heater (i.e. one or more heating element thereof) within the ice mold may be activated to generate heat directed at the mold cavity. For instance, the heater may conduct heat generated by electric resistance at a heating element to the mold cavity from a position below the mold cavity, as described above. The heater may be activated continuously during 530 or, alternatively, intermittently. If activated intermittently, activation may be according to a predetermined cycle or according to signals received from one or more portion of the ice making assembly (e.g., based on one or more temperature signals received from a temperature sensor mounted to the ice making appliance or within the freezer chamber).

At 540, the method 500 may include directing the freezer chamber to a second sub-freezing temperature during an ice maintenance cycle. Generally, 540 is performed subsequent to 520 (e.g., immediately following completion of the ice formation cycle). Moreover, during 540, the frozen volume is understood to remain within the freezer chamber (e.g., within the mold cavity or separate therefrom in a discrete ice container). Thus, the frozen volume is maintained or held at the second sub-freezing temperature for the duration of the maintenance cycle. Optionally, the heater may be deactivated or otherwise held in an inactive state during 540 or for the duration of the maintenance cycle.

The second sub-freezing temperature may be greater than the first sub-freezing temperature. In turn, transitioning from the ice formation cycle to the maintenance cycle may require increasing the temperature within the freezer chamber. Such an increase may occur gradually and as a result of natural heat absorption by the ice making appliance. Optionally, 540 may include deactivating or limiting operation of the sealed cooling system. The sealed cooling system may continue to draw heat from the freezer chamber (e.g., through the evaporator), but at a rate less than would be provided during the ice formation cycle. The second sub-freezing temperature may be a relatively stable temperature (e.g., between 20° Fahrenheit and 32° Fahrenheit). In some embodiments, the first sub-freezing temperature may be 20° Fahrenheit. In other embodiments, the first sub-freezing temperature may be 25° Fahrenheit. In further embodiments, the first sub-freezing temperature may be 30° Fahrenheit.

In some embodiments, 540 is contingent upon completion of the ice formation cycle. In other words, the method 500 may include ensuring that the ice formation cycle is complete before initiating 540 and the ice maintenance cycle. Completion of the ice formation cycle may include determination of one or more predetermined conditions. As an example, the ice formation cycle may have predetermined time (e.g., span of time measured from initiation of the ice formation cycle) after which the ice formation cycle expires. Thus, the ice formation cycle may end upon the predetermined time elapsing. Optionally, the predetermined time may begin when the volume of water is provided within the freezer chamber (e.g., at 510). As another example, the ice formation cycle may end upon a predetermined condition being detected at the ice mold. Optionally, the predetermined condition may include detecting a set temperature been reached at the temperature sensor (e.g., at the ballast height). Detection of the set temperature may indicate that the frozen volume has reached (i.e., frozen to) the ballast height and is therefore at a desired size. Furthermore, it is understood that any other suitable predetermined condition for ascertaining the size of the frozen volume or extent to which the provided volume of water has frozen may be utilized.

In optional embodiments, method 500 includes directing an active airflow across the ice mold. For instance, as described above the air handler within the freezer chamber may be activated or rotated to motivate air within the freezer chamber to flow (i.e., as an active airflow) over or across the ice mold. The active airflow may be provided at one or more periods of the method 500. In particular, the active airflow may be provided at 520, 530, or for the duration of the ice formation cycle. In some such embodiments, the active airflow is motivated a predetermined flow rate (e.g., volumetric flow rate). In other words, the flow rate of the active airflow may remain constant during the ice formation cycle. In other embodiments, active airflow is motivated at a variable flow rate. The flow rate may increase or decrease based one or more received signals or user inputs. For instance, the variable flow rate may be set according to a specific user input. Additionally or alternatively, the variable flow rate may be set automatically according to a sensed condition (e.g., one or more signals received from, for example, the temperature sensor or the pressure sensor mounted to the ice mold).

Optionally, the active airflow may further be provided at 540 or for the duration of the maintenance cycle (e.g., at a flow rate that is less than a flow rate during the ice formation cycle). Alternatively, the active airflow may be halted during 540 or for the duration of the maintenance cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of making ice comprising:

providing a volume of water within a mold cavity defined within an ice mold, the ice mold being positioned within a freezer chamber, the mold cavity comprising a cavity opening at a top portion thereof, the cavity opening extending in a vertical direction in fluid communication between the freezer chamber and the mold cavity;

maintaining the freezer chamber below a first sub-freezing temperature during an ice formation cycle as a portion of the volume of water freezes to a frozen volume;

heating the ice mold during the ice formation cycle at an electrical heating element mounted within the ice mold; and further comprising directing the freezer chamber to a second sub-freezing temperature using a sealed cooling system during an ice maintenance cycle while the frozen volume remains within the freezer chamber, the second sub-freezing temperature being above the first sub-freezing temperature, the ice maintenance cycle being subsequent to the ice formation cycle, wherein the sealed cooling system comprises a compressor, a condenser, an expansion device, and an evaporator connected in fluid series and charged with a refrigerant, and wherein the evaporator is in thermal communication with the freezer chamber.

2. The method of claim 1, further comprising directing an active airflow across the ice mold during the ice formation cycle, wherein the active airflow is halted during the ice maintenance cycle.

3. The method of claim 1, further comprising directing an active airflow across the ice mold during the ice formation cycle.

4. The method of claim 1, wherein the electrical heating element is positioned below the mold cavity.

5. The method of claim 1, wherein a phase change material is positioned within the ice mold in thermal communication with the mold cavity.

6. The method of claim 5, wherein the phase change material is positioned along a bottom portion of the mold cavity.

7. The method of claim 1, wherein the ice mold comprises an insulated sidewall extending along at least a portion of the mold cavity.

8. The method of claim 7, wherein the mold cavity extends vertically from a bottom portion to a top portion, and wherein the insulated sidewall extends from the bottom portion to the top portion.

9. The method of claim 7, wherein the mold cavity extends vertically from a top portion to a bottom portion, and wherein the insulated sidewall extends from the bottom portion to a ballast height defined below the top portion.

10. An ice making appliance comprising:

a cabinet defining a freezer chamber;

a sealed cooling system comprising a compressor, a condenser, an expansion device, and an evaporator connected in fluid series and charged with a refrigerant, the evaporator being in thermal communication with the freezer chamber;

an ice mold positioned within the freezer chamber, the ice mold defining a mold cavity extending vertically in fluid communication with the freezer chamber through a vertical opening;

an electrical heating element mounted within the ice mold in conductive thermal communication with the mold cavity; and a controller in operable communication with the electrical heating element, the controller being configured to initiate an ice making operation, the ice making operation comprising maintaining the freezer chamber below a first sub-freezing temperature during an ice formation cycle subsequent to a volume of water being received within the mold cavity, heating the ice mold during the ice formation cycle at the electrical heating element as a portion of the volume of water freezes to a frozen volume, and directing the freezer chamber to a second sub-freezing temperature using the sealed cooling system during an ice maintenance cycle while the frozen volume remains within the freezer chamber, the second sub-freezing temperature being above the first sub-freezing temperature, the ice maintenance cycle being subsequent to the ice formation cycle.

11. The ice making appliance of claim 10, wherein the ice making operation further comprises directing an active airflow across the ice mold during the ice formation cycle, wherein the active airflow is halted during the ice maintenance cycle.

12. The ice making appliance of claim 10, further comprising an air handler positioned within the freezer chamber, wherein the ice making operation further comprises motivating an active airflow from the air handler across the ice mold during the ice formation cycle.

13. The ice making appliance of claim 10, wherein the electrical heating element is positioned below the mold cavity.

14. The ice making appliance of claim 10, wherein a phase change material is positioned within the ice mold in thermal communication with the mold cavity.

15. The ice making appliance of claim 14, wherein the phase change material is positioned along a bottom portion of the mold cavity.

16. The ice making appliance of claim 10, wherein the ice mold comprises an insulated sidewall extending along at least a portion of the mold cavity.

17. The ice making appliance of claim 16, wherein the mold cavity extends vertically from a bottom portion to a top portion, and wherein the insulated sidewall extends from the bottom portion to the top portion.

18. The ice making appliance of claim 16, wherein the mold cavity extends vertically from a top portion to a bottom portion, and wherein the insulated sidewall extends from the bottom portion to a ballast height defined below the top portion.

* * * * *